US009587361B2

(12) United States Patent
Oetken et al.

(10) Patent No.: US 9,587,361 B2
(45) Date of Patent: Mar. 7, 2017

(54) TEMPERATURE DEPENDENT AUTO ADAPTIVE COMPACTION

(71) Applicant: Caterpillar Paving Products Inc., Brooklyn Park, MN (US)

(72) Inventors: Nicholas Oetken, Brooklyn Park, MN (US); John Marsolek, Watertown, MN (US); Maria Biberdorf, Maple Grove, MN (US); Bryan Downing, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/681,304

(22) Filed: Apr. 8, 2015

(65) Prior Publication Data

US 2016/0298308 A1 Oct. 13, 2016

(51) Int. Cl.

| | |
|---|---|
| ***E01C 19/28*** | (2006.01) |
| ***E02D 3/074*** | (2006.01) |
| ***E02D 3/026*** | (2006.01) |

(52) U.S. Cl.

CPC ..... *E02D 3/074* (2013.01); *E01C 19/288* (2013.01); *E02D 3/026* (2013.01); *E02D 3/0265* (2013.01)

(58) Field of Classification Search

CPC ..... E01C 19/28; E01C 19/288; E01C 19/233; E01C 19/282; E01C 19/283; E01C 19/286; E01C 19/287

See application file for complete search history.

(56) References Cited

U.S. PATENT DOCUMENTS

| | | | | |
|---|---|---|---|---|
| 3,599,543 A * | 8/1971 | Kerridge | ..... | E01C 19/288 404/117 |
| 4,481,835 A | 11/1984 | Storm | | |
| 5,177,415 A * | 1/1993 | Quibel | ..... | E01C 19/288 318/128 |
| 5,727,900 A * | 3/1998 | Sandstrom | ..... | G01P 15/18 404/122 |

(Continued)

FOREIGN PATENT DOCUMENTS

| | | | | |
|---|---|---|---|---|
| CN | 202064262 U | 12/2011 | | |
| CN | 202809452 U | 3/2013 | | |
| WO | WO 9425680 A1 * | 11/1994 | ..... | E01C 19/26 |

OTHER PUBLICATIONS http://www.bomag.com/ru/media/pdf/PRE200250_1007.pdf—Intelligent Asphalt Compaction.

*Primary Examiner* — Frederick L Lagman
(74) *Attorney, Agent, or Firm* — Baker & Hostetler LLP

(57) ABSTRACT

A compactor system for compacting a work material includes a roller drum, a vibratory mechanism, and a controller. The roller drum is configured to compact a work material. The vibratory mechanism is coupled to the roller drum and operatively coupled to the controller. The controller is configured to determine a vibration effort based on a vibration parameter, and further configured to generate an output signal to control the vibratory mechanism to apply the vibration effort to the roller drum. The controller includes at least one sensor and a processor. The at least one sensor is configured to sense a first data parameter of the work material and a second data parameter of the roller drum. The processor is configured to calculate the vibration parameter based on the first data parameter and the second data parameter.

20 Claims, 3 Drawing Sheets

(56) References Cited

U.S. PATENT DOCUMENTS

| | | | | |
|---|---|---|---|---|
| 5,942,679 | A * | 8/1999 | Sandstrom | E01C 19/26 404/133.05 |
| 6,431,790 | B1 * | 8/2002 | Anderegg | E01C 19/288 366/116 |
| 6,749,364 | B1 | 6/2004 | Baker et al. | |
| 7,168,885 | B2 | 1/2007 | Rio et al. | |
| 7,873,492 | B2 | 1/2011 | Ackermann | |
| 8,371,770 | B1 | 2/2013 | Rasmusson et al. | |
| 2004/0009039 | A1 * | 1/2004 | Corcoran | E01C 19/286 404/117 |
| 2006/0034657 | A1 * | 2/2006 | John Rio | E01C 19/288 404/84.1 |
| 2006/0096354 | A1 * | 5/2006 | Commuri | E01C 19/288 73/32 A |
| 2007/0150147 | A1 | 6/2007 | Rasmussen et al. | |
| 2008/0063473 | A1 * | 3/2008 | Congdon | E01C 19/288 404/75 |
| 2008/0260462 | A1 * | 10/2008 | Ackermann | E01C 19/288 404/124 |
| 2008/0267707 | A1 * | 10/2008 | Potts | E01C 19/288 404/117 |
| 2009/0142133 | A1 * | 6/2009 | Glee | E01C 19/004 404/75 |
| 2010/0172696 | A1 * | 7/2010 | Commuri | E01C 19/288 404/117 |
| 2011/0123267 | A1 | 5/2011 | Buschmann et al. | |
| 2013/0136539 | A1 | 5/2013 | Aardema | |
| 2013/0261998 | A1 * | 10/2013 | Anderegg | G01N 3/32 702/56 |

* cited by examiner

TEMPERATURE DEPENDENT AUTO ADAPTIVE COMPACTION

TECHNICAL FIELD

This disclosure relates generally to compactor systems, and more particularly, to a system and method for adjusting the amplitude of a vibratory force during a compaction process.

BACKGROUND

Compactor machines, also variously called compaction machines, are frequently employed for compacting fresh laid asphalt, dirt, gravel, and other compactable work materials associated with road surfaces. For example, during construction of roadways, highways, parking lots and the like, loose asphalt is deposited and spread over the surface to be paved. One or more compactors, which may be self-propelling machines, travel over the surface whereby the weight of the compactor compresses the asphalt to a solidified mass. The rigid, compacted asphalt has the strength to accommodate significant vehicular traffic and, in addition, provides a smooth, contoured surface that may facilitate traffic flow and direct rain and other precipitation from the road surface. Compactors are also utilized to compact soil or recently laid concrete at construction sites and on landscaping projects to produce a densified, rigid foundation on which other structures may be built.

To facilitate the compaction process, compactor machines can include a vibratory mechanism. The vibratory mechanism can help establish a degree of compaction by controlling a vibration amplitude and a vibration frequency. The vibratory mechanism can allow a user to select a target vibration frequency from one or more possible frequencies independent of the vibration amplitude, or may allow a user to select a target vibration amplitude independent of the vibration frequency. Either the vibration amplitude or the vibration frequency can be adjusted while the other remains fixed or uncontrolled. U.S. Pat. No. 4,481,835 describes a system for continuously adjusting the vibration amplitude in order to achieve a desired compaction effect. However, this system fails to consider properties of the material being compacted. As a result, the system is less efficient because multiple passes over the same surface may be required, and the vibration amplitude can cause unintended decoupling to occur, whereby the compactor does not maintain contact with the surface.

Conventional systems have attempted to overcome these deficiencies. U.S. Patent Publication No. 2013/0136539 A1 describes a paving system which includes a sensing element for sensing stress-strain, pressure, temperature, moisture level, and/or other paving parameters useful to assess the paving process. The sensing element includes sensors embedded into the paving material which may provide real time measurements for the level of compaction of the paving material. However, this system requires multiple sensors positioned throughout the paving material increasing the complexity of the paving process. Additionally, the embedded sensors can become damaged during paving resulting in inaccurate measurements and/or replacement costs.

Thus, an improved and/or simplified compaction system for compacting a work material is desired to increase the effectiveness and efficiency of compaction.

SUMMARY

An aspect of the present disclosure provides a compactor system for compacting a work material. The compactor system includes a roller drum, a vibratory mechanism, and a controller. The roller drum is configured to compact the work material. The vibratory mechanism is coupled to the roller drum. The controller is operatively coupled to the vibratory mechanism and is configured to determine a vibration effort based on a vibration parameter. The controller is further configured to generate an output signal to control the vibratory mechanism to apply the vibration effort to the roller drum. The controller includes at least one sensor and a processor. The at least one sensor is configured to sense a first data parameter of the work material and a second data parameter of the roller drum. The processor is configured to calculate the vibration parameter based on the first data parameter and the second data parameter.

Another aspect of the present disclosure provides a compactor system for compacting a work material. The compactor system includes a vibratory mechanism and a controller. The vibratory mechanism is configured to output a vibration effort. The controller is operatively coupled to the vibratory mechanism and configured to determine the vibration effort based on a vibration parameter. The controller is further configured to generate an output signal to control the vibratory mechanism to output the vibration effort. The controller includes a first sensor, a second sensor, and a processor. The first sensor is configured to sense a first data parameter of the work material. The second sensor is configured to sense a second data parameter of the compactor system. The processor is configured to calculate the vibration parameter based on the second data parameter and the first data parameter.

Another aspect of the present disclosure provides a method for compacting a work material by a roller drum of a compactor system. The method includes sensing a first data parameter of the work material and sensing a second data parameter of the roller drum. The method further includes calculating a vibration parameter based on the first data parameter and the second data parameter. The method further includes generating an output signal to control the vibratory mechanism to apply a first vibration effort based on the vibration parameter.

DETAILED DESCRIPTION

The disclosure relates generally to a vibratory compactor machine having one or more roller drums that are in rolling contact with a surface to be compacted. A compactor may be used in situations where loose work material is disposed over the surface. Work material may include asphalt, soil, gravel, sand, land fill trash, concrete, combinations thereof, or other material capable of being compacted. As the compactor machine travels over the surface, vibrational forces generated by the compactor machine and imparted to the surface act in cooperation with the weight of the machine to compress the work material to a state of greater compaction and density. The vibrational forces imparted to the surface may be determined based on properties of the work material, such as temperature. The compactor may make one or more passes over the surface to provide a desired level of compaction.

Figure 1:
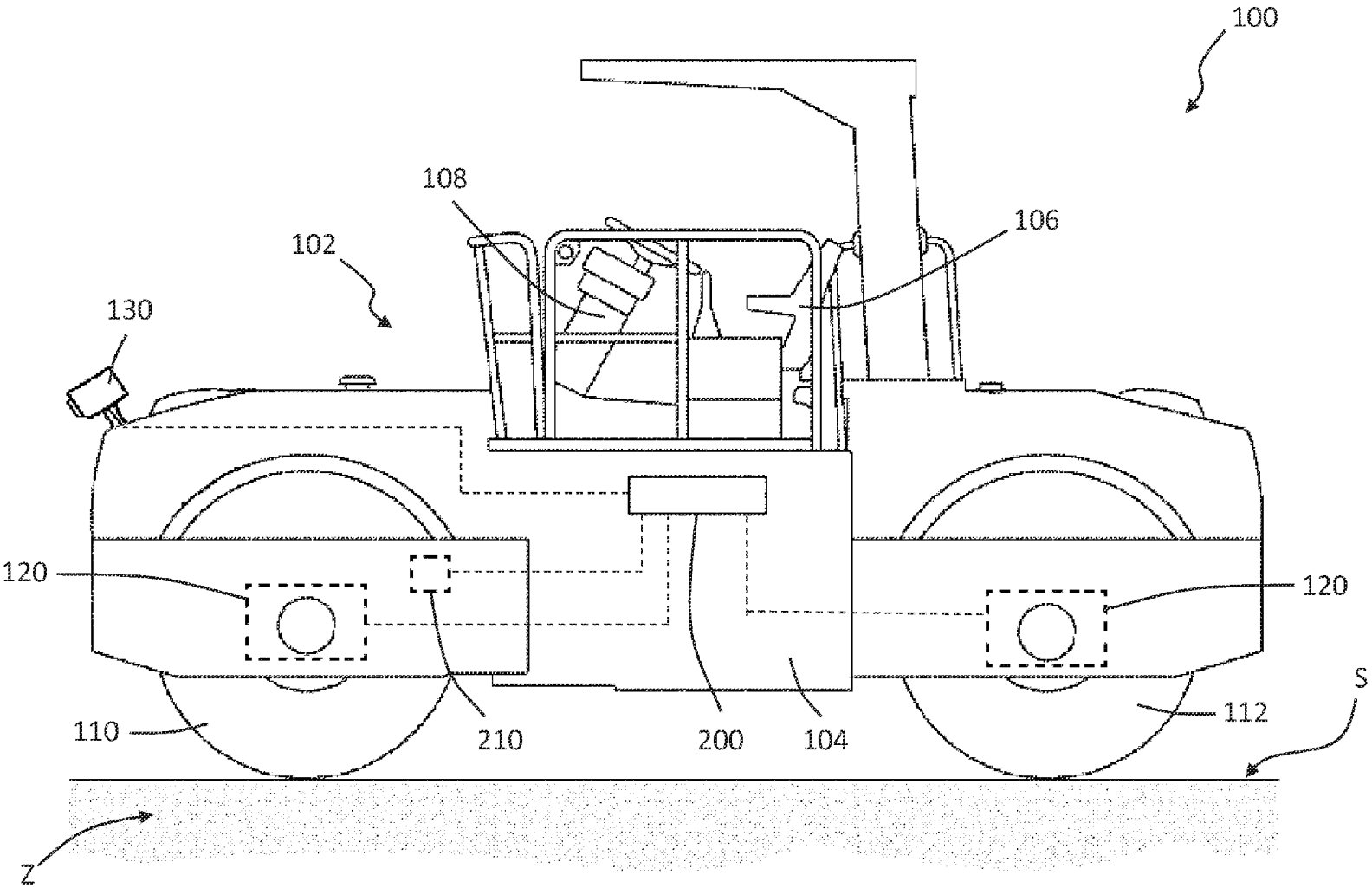
FIG. 1 is a side view of a compactor system, according to an aspect of this disclosure.

FIG. 1 illustrates the side view of a compactor system 100, according to one aspect of the disclosure. In this view, an exemplary compactor system 100 is shown that can travel over a surface S compacting a work material Z under its own power, and which may implement aspects of the disclosure. Other types of compactors are contemplated to implement the disclosed process and device including soil compactors, asphalt compactors, utility compactors, pneumatic compactors, vibratory compactors, self-propelled two-wheel and four-wheel compactors, and tow-behind systems, for example. The compactor system 100 includes a compactor machine 102 that includes a body or frame 104 that interoperatively connects and associates the various physical and structural features that enable the compactor machine 104 to function. These features may include an operator cab 106 that is mounted on top of the frame 104, from which an operator may control and direct operation of the compactor machine 102. Additionally, a steering apparatus 108 and similar controls may be located within the operator cab 106. To propel the compactor machine 102 over the surface S, a power system (not shown), such as an internal combustion engine, can also be mounted to the frame 104 and can generate power to physically move the compactor machine 102. One or more other implements (not shown) may be connected to the machine. Such implements may be utilized for a variety of tasks, including, for example, loading, lifting, and brushing, and may include, for example, buckets, forked lifting devices, brushes, grapples, cutters, shears, blades, breakers/hammers, augers, and any other implement known in the art.

To enable motion of the compactor machine 102 relative to the surface S, the illustrated compactor machine 102 includes a first roller drum 110 (or compacting element 110) and a second roller drum 112 (or compacting element 112) that are in rolling contact with the surface S. Both the first roller drum 110 and the second roller drum 112 are rotatably coupled to the frame 104 so that the first and second roller drums 110, 112 roll over the surface S as the compaction machine 102 travels thereon. For reference purposes, the compactor machine 102 may have a typical direction of travel such that the first roller drum 110 may be considered the forward drum and the second roller drum 112 may be considered the rear of the machine 102. As used herein, the terms "forward" and "rear" refer to locations on the compactor machine 102 located toward the first roller drum 110 and the second roller drum 112, respectively. In the illustrated aspect, to transfer motive power from the power system to the surface S, the power system can operatively engage and rotate the first roller drum 110, the second roller drum 112, or combinations thereof, through an appropriate power train.

It will be appreciated that the first roller drum 110 can have the same or different construction as the second roller drum 112. In particular, the first roller drum 110 may include an elongated, hollow cylinder with a cylindrical drum shell that encloses an interior volume. The cylindrical roller drum extends along and defines a cylindrical drum axis. The drum shell may be made from a thick, rigid material such as cast iron or steel to withstand being in rolling contact with and compacting the surface S. While the illustrated aspect shows the surface of the drum shell having a smooth cylindrical shape, in other aspects, a plurality of bosses, pads, padfeet, or the like may protrude from the surface of the drum shell to, for example, break up aggregations of the work material Z being compacted. It should further be appreciated that the machine 102 may include a single roller drum and rubber tires (not shown) configured to contact the surface S.

Both the first roller drum 110 and the second roller drum 112 may have a vibratory mechanism 120. While FIG. 1 shows both the first and second roller drums 110, 112 having a vibratory mechanism 120, in other aspects there may be a single vibratory mechanism 120 located on either the first or the second roller drum 110, 112. In still other aspects, a single vibratory mechanism 120 or multiple vibratory mechanisms 120 may be located at different locations on the compactor machine 102.

The vibratory mechanism 120 may be disposed inside the interior volume of the roller drum. In an aspect of this disclosure, the vibratory mechanism 120 includes one or more weights or masses disposed inside the roller drum at a position off-center from the axis around which the roller drum rotates. As the roller drum rotates, the off-center or eccentric positions of the masses induce oscillatory or vibrational forces to the drum that are imparted to the surface S being compacted. The weights are eccentrically positioned with respect to the common axis and are typically movable with respect to each other about the common axis to produce varying degrees of imbalance during rotation of the weights. The amplitude of the vibrations produced by such an arrangement of eccentric rotating weights may be varied by positioning the eccentric weights with respect to each other about their common axis to vary the average distribution of mass (i.e., the centroid) with respect to the axis of rotation of the weights. Vibration amplitude in such a system increases as the centroid moves away from the axis of rotation of the weights and decreases toward zero as the centroid moves toward the axis of rotation. In some applications, the eccentrically positioned masses are arranged to rotate inside the roller drum independently of the rotation of the drum. In alternative aspects, any vibratory mechanism 120 that applies a vibration effort to the first roller drum 110 and/or the second roller drum 112 may be used. As used herein, the term "vibration effort" refers to vibration parameters, such as the amplitude, frequency, or amplitude and frequency of the vibration produced by the vibratory mechanism 120.

To facilitate control and coordination of the compactor machine 102, the compactor machine 102 may include a controller 200, such as an electronic control unit, which may be used to facilitate control and coordination of any methods or procedures described herein. While the controller 200 illustrated in FIG. 1 is distributed as a plurality of distinct but interoperating units, in other aspects the controller 200 may be embodied as a single unit, incorporated into another component, or located at a different location on or off the compactor machine 102.

Figure 2:
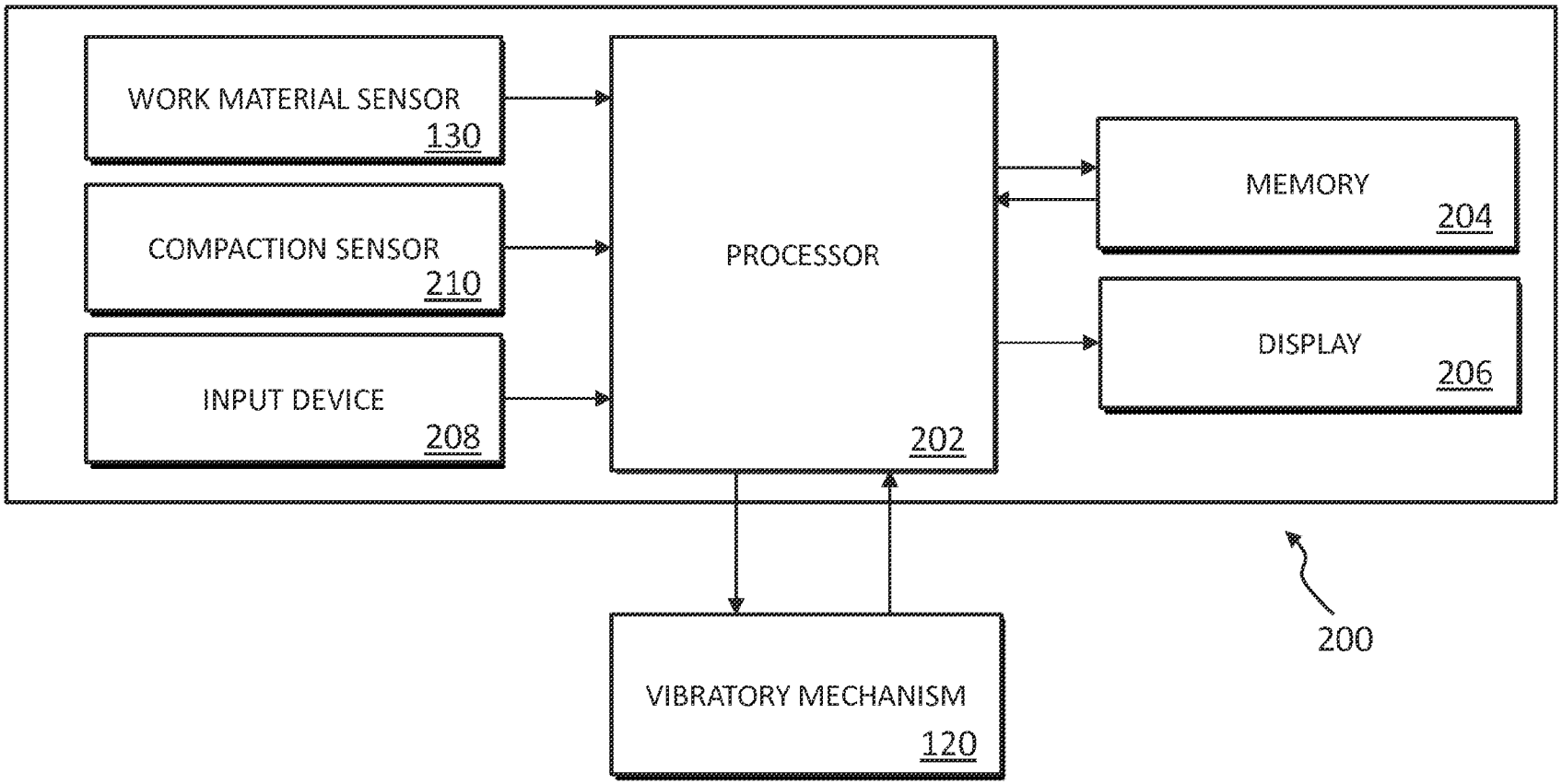
FIG. 2 is a block diagram of a controller, according to an aspect of this disclosure.

FIG. 2 illustrates a block diagram of a controller 200, according to an aspect of the disclosure. The controller 200 may include a processor 202, a memory 204, a display or output 206, an input device 208, work material sensor 130, a compaction sensor 210, or combinations thereof. The main unit of the controller 200 may be located in the operator cab 106 for access by the operator and may communicate with the steering feature 108, the power system, and with various other sensors and controls on the compactor machine 102.

The controller 200 may be coupled to the vibratory system 120 through either wired or wireless communication methods known in the art. The controller 200 may be configured to control the vibratory mechanism 120 to apply a vibration effort to the first roller drum 110, the second roller drum 112, or combinations thereof, to achieve a target compaction as described further herein.

As illustrated in FIG. 2, the processor 202 may be coupled to the work material sensor 130 and the compaction sensor 210. The processor 202 may be configured to output signals that are responsive to inputs from work material sensor 130 and the compaction sensor 210, as further described herein. A display 206 may also be coupled to the processor 202 and may be positioned in the operator cab 106 to display various data to an operator relating to the machine position, ground stiffness, surface temperature, vibration effort, or other parameters. Action may be taken in response to the surface temperature or other compaction metrics including commencing the compaction process within the work area, stopping travel of the compactor machine 102, modifying the vibration effort, or redirecting or otherwise changing a planned compactor travel path or coverage pattern.

The work material sensor 130 and the compaction sensor 210 each may include a signal transducer configured to sense a transmitted signal, or component of a transmitted signal, for example, a signal reflected by the surface S. As illustrated in FIG. 1, the compactor system 100 may include a single work material sensor 130 and a single compaction sensor 210, however, it will be appreciated that additional sensors may be incorporated into the compactor system 100.

The work material sensor 130 may be configured to sense a parameter indicative of the work material Z, such as a temperature, a density, a thickness, a resilience, combinations thereof, or any other parameter of the work material Z known in the art. As illustrated in FIG. 1, the compactor machine 102 may include a single work material sensor 130 coupled to the front of the compactor machine 102. It will be appreciated that the controller 200 may include more than one work material sensor 130 located at various positions on the compactor machine 102.

The compaction sensor 210 may be configured to sense a parameter indicative of an acceleration, a velocity, a displacement, and/or a force of a component of the compactor machine 102. The components may include the first roller drum 110, the second roller drum 112, the compactor frame 104, or the like. As illustrated in FIG. 1, a single compaction sensor 210 is coupled in proximity to and resident on the first roller drum 110. In other aspects, additional sensors such as a rearward sensor (not shown) associated with the second roller drum 112 or separate sensors for measuring an acceleration a velocity, a displacement, and/or a force of the first roller drum 110, the second roller drum 112, or the compactor frame 104 may be used.

The processor 202 receives signals indicative of values sensed by the work material sensor 130 and the vibration sensor 210, may store the values in the computer readable memory 204, and use the values to calculate a vibration effort to apply to the first roller drum 110 and/or the second roller drum 112 using algorithms stored in the memory 204. The processor 202 may calculate the vibration effort based on predetermined threshold values for the parameters indicative of the work material Z and the acceleration, the velocity, the displacement, and/or the force of a component of the compactor machine 102. The predetermined thresholds may be input or adjusted by an operator through the input device 208 or by other means. The processor 202 may send an output signal to the vibratory mechanism 120 to effect the calculated vibration effort, and may also send a signal to the display 206 to communicate the present vibration effort being applied by the vibratory mechanism 120. The calculation of the vibration effort may be repeated continuously until compaction is complete. Examples of processors include computing devices and/or dedicated hardware as defined herein, but are not limited to, one or more central processing units and microprocessors.

The computer readable memory 204 may include random access memory (RAM) and/or read-only memory (ROM). The memory 204 may store computer executable code including a control algorithm for determining a vibration effort to apply to the first roller drum 110 and the second roller drum 112 responsive to inputs from the work material sensor 130 and the vibration sensor 210. The memory 204 may also store various digital files including values sensed by the work material sensor 130, the vibration sensor 210, or input from the input device 208. The information stored in the memory 204 may be provided to the processor 202 so that the processor 202 may determine a vibration effort.

The display 206 may be located on the compactor machine 102, remotely from the compactor machine 102, or combinations thereof, and may include, but is not limited to, cathode ray tubes (CRT), light-emitting diode display (LED), liquid crystal display (LCD), organic light-emitting diode display (OLED), or a plasma display panel (PDP). Such displays can also be touchscreens and may incorporate aspects of the input device 208. The display 206 may also include a transceiver that communicates over a communication channel.

Figure 3:
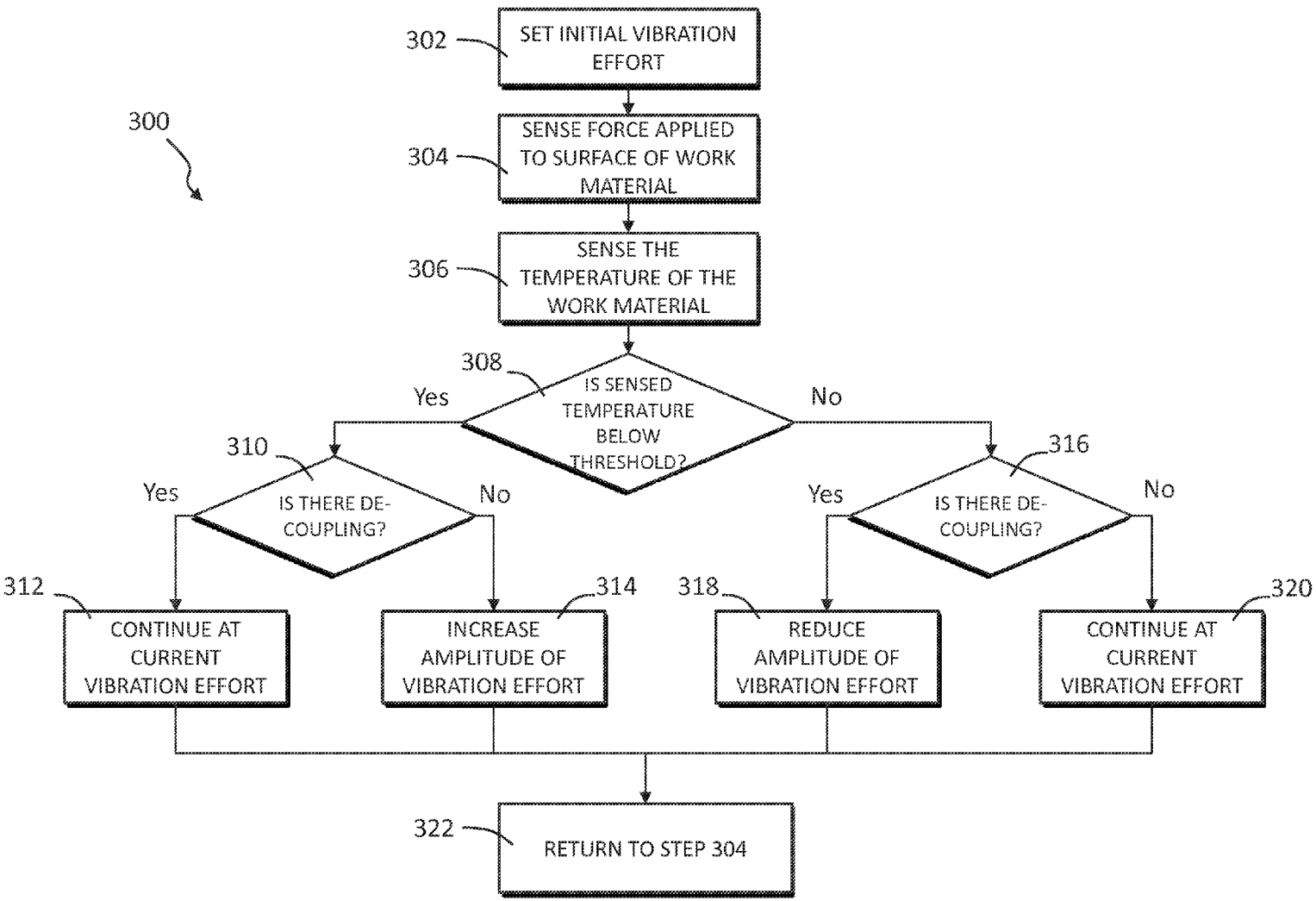
FIG. 3 is a flowchart depicting a method for determining a vibration effort, according to an aspect of this disclosure.

FIG. 3 is a flowchart depicting a method 300 for determining a vibration effort to apply to a vibratory mechanism 120, according to an aspect of this disclosure. In this aspect, the compaction sensor 210 may be configured to sense a force applied by the first roller drum 110 and/or the second roller drum 112 to the surface S of the work material Z, and the work material sensor 130 may be configured to sense a surface temperature of the work material Z. The applied force and the surface temperature may be sensed in real-time or near real-time during a compaction process. Using these values, the processor 202 may calculate a vibration parameter, and the controller 200 may determine a target vibration effort based on the vibration parameter. The controller 200 may generate and transmit a signal to the vibratory mechanism 120 to apply the target vibration effort to the first roller drum 110 and/or the second roller drum 112. In an aspect of this disclosure, the vibration parameter includes the amplitude of a vibration force.

At step 302, an initial vibration effort is set and may be applied by the vibratory mechanism 120, which may be performed prior to the start of the compaction process or during the compaction process. Various factors may be taken into account prior to setting the initial vibration effort including, for example, the type of the work material Z, a temperature of the work material Z, a density of the work material Z, a weight of the compactor machine 102, a velocity of the compactor machine 102, combinations thereof, or other factors that may be useful to the compaction process. It will be appreciated that the initial vibration effort may be zero, such that no initial vibration force and no initial vibration frequency are applied to the first roller drum 110 and/or the second roller drum 112.

At step 304, a contact force between the surface S of the work material Z and the first roller drum 110 and/or the second roller drum 112 is sensed by the compaction sensor 210. In an aspect, the compaction sensor 210 may be, but is not limited to, a hydraulic load cell, a strain gauge load cell, or any other force or pressure sensor known in the art. It will be appreciated that the contact force may also be determined by calculating the contact force using physical properties of the compactor machine 102, the vertical accelerations of the first roller drum 110 and/or the second roller drum 112, the vertical acceleration of the compactor frame 104, and the vibrational properties, if any, of the first roller drum 110 and/or the second roller drum 112. The physical properties may include the mass of the first roller drum 110, the mass of the second roller drum 112, the mass of the compactor frame 104, or the like.

At step 306, a temperature of the work material Z is sensed by the work material sensor 130. In an aspect, the work material sensor 130 is a thermal imager, a thermal scanner, or other sensor capable of sensing the temperature of the work material Z. The temperature of the work material Z may include a surface temperature of an area or a specific point, or a temperature of the work material Z below the surface S.

At step 308, the temperature of the work material sensed at step 306 is compared to a predetermined temperature threshold. The predetermined temperature threshold may be stored in the memory 204 of the controller 200. Depending on whether the sensed temperature is below the predetermined temperature threshold will determine whether to increase, decrease, or keep the vibration effort the same. It will be appreciated that the predetermined temperature threshold may be updated or modified by an operator or otherwise at any point during the compaction process.

At step 310, if the temperature of the work material sensed at step 306 is below the predetermined temperature threshold, the contact force between the surface S of the work material Z and the first roller drum 110 and/or the second roller drum 112, sensed or otherwise calculated at step 304, is used to determine whether de-coupling has occurred. De-coupling occurs when the contact force is substantially zero, which may indicate that the first roller drum 110 and/or the second roller drum 112 is not in contact with the surface S of the work material Z. De-coupling may occur when the amplitude of the applied vibratory effort is at such a high level to cause the first roller drum 110 and/or the second roller drum 112 to effectively bounce on the surface S. De-coupling may result in unintended consequences, such as producing a non-uniform compaction surface, damaging the work material Z being compacted, or otherwise impede the compaction effort.

At step 312, if the sensed temperature is below the predetermined temperature threshold and there is de-coupling, the controller 200 continues to control the vibratory mechanism 120 to apply the current vibratory effort. When the temperature of the work material Z is below the predetermined temperature threshold, more force may be required to compact the material than if the temperature of the work material Z is above the predetermined temperature threshold. Further, if the compaction density of the work material Z after compaction is below a certain threshold, the work material Z may require multiple passes by the compactor machine 102, or may have to be partially or completely re-laid. Therefore, in this situation, the risk of unintended consequences due to de-coupling is less than the potential benefit of applying a vibratory effort with a high amplitude. Thus, the vibratory mechanism 120 continues to apply the current vibration effort even though de-coupling has occurred.

At step 314, if the sensed temperature is below the predetermined temperature threshold and there is no de-coupling, the controller 200 increases the amplitude of the vibration effort and controls the vibratory mechanism 120 to apply the modified vibratory effort. Because no de-coupling has been determined, the risk of unintended consequences impacting the work material Z may be minimal. The increase in amplitude to the vibration effort may be a percentage increase or an incremental increase in magnitude.

At step 316, if the temperature of the work material sensed at step 306 is above the predetermined temperature threshold, the sensed or otherwise calculated contact force between the surface S of the work material Z and the first roller drum 110 and/or the second roller drum 112 is used to determine whether de-coupling has occurred. Step 316 may be substantially similar to step 310 in determining whether de-coupling has occurred.

At step 318, if the sensed temperature is above the predetermined temperature threshold and there is de-coupling, the controller 200 reduces the amplitude of the vibration effort and controls the vibratory mechanism 120 to apply the modified vibration effort. The reduction in amplitude of the vibration effort minimizes the risk of unintended consequences due to de-coupling. Because the temperature is above the predetermined temperature threshold, the work material Z may be sufficiently compacted with a reduced amplitude of the vibration effort. The reduction in amplitude of the vibration effort may be a percentage decrease or an incremental decrease in magnitude.

At step 320, if the sensed temperature is above the predetermined temperature threshold and there is no de-coupling, the controller 200 continues to control the vibratory mechanism 120 to apply the current vibratory effort. Because no de-coupling has been determined and the temperature of the work material Z is above the predetermined temperature threshold, the risk of unintended consequences impacting the work material Z may be minimal and the material Z may be sufficiently compacted.

After steps 312, 314, 318, and 320 are complete, the method 300 returns to step 304 to repeat the process of determining a vibration effort to apply to a vibratory mechanism 120. The method 300 may be performed automatically using a closed loop feedback controller 200.

In an alternate aspect of the method 300, the temperature of the work material Z sensed at step 306 may be used to determine a vibration effort based on lookup tables. For example, the memory 204 may store multiple lookup tables for a variety of work materials Z. Each table may relate a temperature of the work material Z to an optimal vibrational amplitude and frequency. Based on the sensed temperature, the controller 200 may look up the corresponding vibration effort and send a signal to the vibratory mechanism 120 to control the vibratory mechanism to apply the corresponding vibration effort. The controller 200 may continuously update the vibration effort during the compaction process as the temperature of the material Z changes.

In another alternate aspect of this disclosure, the work material sensor 130 may be further configured to sense the density of the work material Z. The density of the work material Z may be stored in the memory 204 and used by the controller 200 to determine the vibration effort. For example, if the density of the work material Z is below a target compaction density, the amplitude of the vibration effort may be increased. Or, if the density of the work material Z is consistent with or more than a target density, the amplitude of the vibration effort may remain the same or be reduced. It will be appreciated that the target compaction density may be a value stored in memory 204 and used by the controller 200 to determine a vibration effort, or it may be a value used by an operator to manually adjust the vibration effort. In a preferred aspect, the work material sensor 130 is configured to sense the density of the work material Z immediately after compaction, for example, after the second roller drum 112 compacts the work material Z.

INDUSTRIAL APPLICABILITY

The present disclosure provides an advantageous system and method for compacting a work material Z. The controller 200 is configured to determine an appropriate vibration effort to apply during compaction, which allows the compactor system 100 to compact work materials under a variety of conditions. For example, the system 100 may compact a recently laid work material or a work material that has been previously laid and has begun to settle and cool. During a compaction operation, a parameter of the work material Z may be sensed, such as a surface temperature, along with a parameter of the compaction effort, such as a contact force between the compactor machine 102 and the surface S. The surface temperature and contact force may then be used to set or modify the vibration effort accordingly.

Applying a vibration effort specific to a parameter of the work material Z may minimize the need for multiple passes during compaction. For example, if the temperature of the work material Z is lower than an optimal compacting temperature, more force may be required to compact the material Z to a target compaction density. Therefore, adjusting a vibration parameter of the vibration effort, such as the vibration amplitude, may provide the additional force required to effectively compact the work material Z.

Increasing the vibration amplitude may create unintended consequences, such as de-coupling. The potential for de-coupling should be minimized, however, in certain circumstances the risk due to de-coupling might be outweighed by the benefit of minimizing additional compaction work. The compaction method 300 provides a way for the controller 200 to increase the amplitude of the vibration effort to a level that creates a balance between the risk of unintended consequences and the benefit of minimizing additional compaction work.

It will be appreciated that any method or function described herein may be embodied in a non-transitory computer-readable medium for causing the controller 200 to effect the method or function.

We claim:

1. A compactor system comprising:
- a roller drum configured to compact a work material;
- a vibratory mechanism coupled to the roller drum; and
- a controller operatively coupled to the vibratory mechanism, the controller being configured to determine a vibration effort based on a vibration parameter, and to generate an output signal to control the vibratory mechanism to apply the vibration effort to the roller drum, the controller including:
  - at least one sensor configured to sense a first data parameter of the work material, and further configured to sense a second data parameter of the roller drum; and
  - a processor configured to calculate the vibration parameter based on the first data parameter and the second data parameter.

2. The compactor system of claim 1, wherein the first data parameter is a surface temperature of the work material, and wherein the second data parameter is a contact force between the roller drum and the work material.

3. The compactor system of claim 2, wherein the at least one sensor is a thermal imager.

4. The compactor system of claim 2, wherein the vibration parameter is the amplitude of a vibration force.

5. The compactor system of claim 4, wherein the controller is further configured to determine whether de-coupling has occurred between the roller drum and the work material.

6. The compactor system of claim 5, wherein the processor is further configured to calculate the amplitude of the vibration force based on a predetermined temperature threshold.

7. The compactor system of claim 6, wherein the predetermined temperature threshold is adjustable by an operator of the compactor system.

8. The compactor system of claim 1, wherein the at least one sensor is further configured to sense a density of the work material, and wherein the processor is further configured to calculate the vibration parameter based on the density of the work material.

9. The compactor system of claim 1, wherein the at least one sensor is further configured to sense the first data parameter prior to the roller drum compacting the work material.

10. A compactor system for compacting a work material comprising:
- a vibratory mechanism configured to output a vibration effort; and
- a controller operatively coupled to the vibratory mechanism, the controller being configured to determine the vibration effort based on a vibration parameter, and to generate an output signal to control the vibratory mechanism to output the vibration effort, the controller including:
  - a first sensor configured to sense a first data parameter of the work material;
  - a second sensor configured to sense a second data parameter of the compactor system; and
  - a processor configured to calculate the vibration parameter based on the second data parameter and the first data parameter.

11. The compactor system of claim 10 wherein the first data parameter is a temperature of the work material.

12. The compactor system of claim 10, wherein the second data parameter is a contact force between the compactor system and the work material.

13. The compactor system of claim 10, wherein the vibration parameter is the amplitude of a vibration force.

14. The compactor system of claim 13, wherein the processor is further configured to calculate the vibration parameter based on a predetermined temperature threshold.

15. The compactor system of claim 14, wherein the predetermined threshold is adjustable by an operator of the compactor system.

16. The compactor system of claim 10, wherein the controller further includes a third sensor, wherein the third sensor is configured to sense a density of the work material, and wherein the processor is further configured to calculate the vibration parameter based on the density of the work material.

17. A method for compacting a work material by a roller drum of a compactor system, the method comprising:
- sensing a first data parameter of the work material;
- sensing a second data parameter of the roller drum;
- calculating a vibration parameter based on the first data parameter and the second data parameter; and
- generating an output signal to control the vibratory mechanism to apply a first vibration effort based on the vibration parameter.

18. The method of claim 17, wherein the first data parameter is the temperature of the work material, and wherein the second data parameter is a contact force between the roller drum and the work material.

19. The method of claim 18, further comprising:

compacting the work material while the vibratory mechanism is controlled to apply the first vibration effort;

sensing a second data parameter of the work material; and controlling the vibratory mechanism to apply a second vibration effort to the roller drum based on the first data parameter of the work material and the second data parameter of the work material.

20. The method of claim 19, wherein the second data parameter is a density of the work material, and wherein sensing the density of the work material is performed after the work material has been compacted by the roller drum.

* * * * *